US007690745B2

(12) United States Patent
Ouchi

(10) Patent No.: US 7,690,745 B2
(45) Date of Patent: Apr. 6, 2010

(54) RECORDING APPARATUS AND RECORDING METHOD

(75) Inventor: Tetsuya Ouchi, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 628 days.

(21) Appl. No.: 11/288,357

(22) Filed: Nov. 29, 2005

(65) Prior Publication Data

US 2006/0112845 A1 Jun. 1, 2006

(30) Foreign Application Priority Data

Nov. 29, 2004 (JP) ..... 2004-344018

(51) Int. Cl.
*B41J 29/38* (2006.01)

(52) U.S. Cl. ..... 347/14; 347/19

(58) Field of Classification Search ..... 347/14, 347/19, 101, 104, 116
See application file for complete search history.

(56) References Cited

U.S. PATENT DOCUMENTS

| | | | | |
|---|---|---|---|---|
| 6,109,745 | A | 8/2000 | Wen | |
| 7,407,245 | B2 * | 8/2008 | Endo | 347/14 |
| 2002/0110380 | A1 | 8/2002 | McIntyre | |
| 2003/0095722 | A1 | 5/2003 | Regimbal | |
| 2004/0119768 | A1 | 6/2004 | Endo | |
| 2004/0212648 | A1 | 10/2004 | Arakawa et al. | |
| 2004/0246285 | A1 * | 12/2004 | Endo | 347/14 |

FOREIGN PATENT DOCUMENTS

| | | |
|---|---|---|
| JP | 596835 | 4/1993 |
| JP | 2002127392 | 5/2002 |
| JP | 200353953 | 2/2003 |
| JP | 2003205654 | 7/2003 |

OTHER PUBLICATIONS

European Search Report dated May 29, 2006.

* cited by examiner

*Primary Examiner*—Thinh H Nguyen
(74) *Attorney, Agent, or Firm*—Baker Botts, LLP.

(57) ABSTRACT

Angles of inclination of the left and right end edges of recording paper as a recording medium are detected. In the case where it is determined an image having a size extended from an image recording region of the recording paper is recordable over the image recording region or even in the case where it is determined that the image represented by the image data is not recordable over the image recording region of the recording paper, when an input operation is performed indicating the user's intention to continue recording, an image data conversion process is performed for converting a color of a portion of the image data, which is not to be recorded in the image recording region of the recording paper, into a color of which ink is not to be ejected. Thereby, ink is ejected only to the image recording region of the recording paper.

30 Claims, 13 Drawing Sheets

RECORDING APPARATUS AND RECORDING METHOD

CROSS-REFERENCE TO RELATED APPLICATIONS

This nonprovisional application claims priority under 35 U.S.C §119(a) on Patent Application No. 2004-344018 filed in Japan on Nov. 29, 2004, the entire contents of which are hereby incorporated by reference.

BACKGROUND

The present invention relates to a recording apparatus for recording an image by ejecting ink to a recording medium, and a method for recording an image on a recording medium.

A recording apparatus (inkjet printer) is conventionally known which ejects ink to a recording medium (e.g. recording paper of A-4 size, B5-size, etc.), while conveying the recording medium, to record an image. In such a recording apparatus, the following two operations are alternately repeated. One operation is ejecting ink from a nozzle array, composed of a plurality of nozzles arranged along a conveying direction (sub-scanning direction) of the recording medium, based upon image data representing an image while scanning a recording head having the nozzle array in a direction (main-scanning direction) orthogonal to the conveying direction (sub-scanning direction) of the recording medium, to record part of the image in strip shape. The other operation is conveying a prescribed amount of recording medium. By the alternative repetition of these operations, the image is recorded on the recording medium.

In recent years, there has also been a recording apparatus capable of recording an image on the whole area of a recording medium without providing any margins thereon, namely performing a frameless recording. In the case of performing such a frameless recording, if ink is ejected to a position protruding from the recording medium, the recording medium is stained with ink as well as ink is wasted. It is therefore preferable to allow ink to be ejected only to the recording medium. However, if the recording medium is conveyed in an inclined state for some reason, the position of the recording medium is displaced from the assumed position thereof, which may lead to occurrence of an empty space on the recording medium and ejection of ink to a position protruding from the recording medium.

Hence there is a recording apparatus provided with a sensor in a carriage for detecting the end edge of the recording medium in a width direction. The end edge of the recording medium in a width direction is detected using the sensor so that recording is performed within the range of each end edge of the recording medium (cf. Japanese Patent Laid-Open Application No. 2003-53953).

Further, there is also a recording apparatus comprising two oblique movement detecting sensors with prescribed intervals therebetween on a platen. When oblique movement of the recording medium is detected by the oblique movement detecting sensor, image data is rotationally converted in accordance with the angle of the detected oblique movement (cf. Japanese Patent Application Laid-Open No. 2002-127392).

SUMMARY

However, the foregoing configuration described in Japanese Patent Application Laid-Open No. 2003-53953 has the problem of failing to perform favorable recording on the end edge of the recording medium. Namely, with the recording medium in an inclined state, each of the nozzles constituting the nozzle array has a different positional relation (distance) in the main-scanning direction with the end edge of the recording medium. On this account, when recording is performed such that ink does not protrude from the recording medium, a stepwise empty space occurs on the edge of the recording medium, as shown in FIG. 1. On the contrary, when recording is performed such that an empty space does not occur, ink ejected from part of the nozzles constituting the nozzle array protrudes from the recording medium.

It is to be noted that, according to the foregoing configuration described in Japanese Patent Application Laid-Open No. 2002-127392, although it is possible to avoid the above-mentioned problem, it requires the complicated process for rotationally converting image data, which causes increases in cost and further in process time. Avoiding the above-mentioned problem in such a manner is thus not realistic.

It is therefore an object to perform favorable recording even to a recording medium conveyed in an inclined state.

A recording apparatus according to a first aspect for achieving the above object comprises conveying unit for conveying a recording medium, and ink ejection unit having a plurality of nozzles. It should be noted that the term "recording medium" here means a medium capable of recording an image (including a character and a symbol) by ejection of ink. Examples of the recording medium may include a sheet member such as recording paper. For example, in an inkjet printer well known as a recording apparatus, a plurality of nozzles respectively corresponding to a plurality of colors are arranged in a recording head as the ink ejection unit in order to realize full-color recording.

Moreover, the recording apparatus according to the first aspect comprises image recording unit. The image recording unit ejects ink from the nozzles of the ink ejection unit based upon image data representing an image, to record the image represented by the image data on the recording medium conveyed by the conveying unit, while scanning the ink ejection unit in a scanning direction orthogonal to the conveying direction of the recording medium.

Namely, ink is ejected from the nozzles while the ink ejection unit is scanned in the scanning direction, to record an image in a strip-shaped region having a prescribed width (width by the arrangement of the nozzles to eject ink) in the conveying direction. It is possible, by performing such image recording a plurality of times, to record the image over a region (also referred to as "image recording region") of the recording medium where the image is to be recorded. In the case of frameless recording, the image recording region is the whole area of the recording medium. In the case of frame-existing recording, the image recording region is a region left after excluding the outer edge of the recording medium from the whole area thereof (e.g. a region left after forming margins in prescribed widths on the top, bottom, left and right of the recording medium). For example, in the well-known inkjet printer, an image is recorded in an image recording region set by a user.

Furthermore, the recording apparatus according to the first aspect comprises inclination detecting unit and ejecting position control unit. The inclination detecting unit detects the degree of inclination of the end edge of the recording medium conveyed by the conveying unit, the end edge being along the conveying direction, to the conveying direction. The ejecting position control unit controls an ink-ejection starting position and an ink-ejection ending position of each of the nozzles in the scanning direction at the time of image recording on the recording medium by the image recording unit, according to the degree of inclination detected by the inclination detecting unit.

Specifically, for example, when the end edge of the recording medium along the conveying direction is not inclined to the conveying direction, the ink-ejection starting position and the ink-ejection ending position of each of the nozzles in the scanning direction are made the same. When the end edge of the recording medium along the conveying direction is inclined to the conveying direction, the ink-ejection starting position and the ink-ejection ending position of each of the nozzles in the scanning direction are made different according to the degree of inclination. It is thereby possible to record the image along the end edge of the recording medium.

It is to be noted that, the terms "ink-ejection starting position" and "ink-ejection ending position" here are positions at which image recording is started and ended, respectively. Namely, for example, there are some cases where ink is not ejected depending upon the color of the image (e.g. in the well-known inkjet printer, ink is not ejected for a white part of the image on the assumption that the recording medium is white). The above description: "the ink-ejection starting position and the ink-ejection ending position of each of the nozzles in the scanning direction are made the same" only means that a position at which image recording is started and a position at which image recording is ended are made the same, though there are some cases where ink is not ejected depending upon the color of the image, and it goes without saying that ink of a color which is not to be ejected is not ejected. That is, "controlling the ink-ejection starting position and the ink-ejection ending position of each of the nozzles in the scanning direction" means "controlling an ink-ejection inhibited area (area in which ejection of ink is inhibited) of each of the nozzles in the scanning direction, by making those areas the same, different, or by other means."

According to the recording apparatus of the first aspect as thus described, it is possible to prevent ejection of ink to the outside of the image recording region of the recording medium, while allowing image recording over the image recording region, even when the recording medium is conveyed in an inclined state. Specifically, when the image recording region is the whole area of the recording medium (frameless recording), it is possible to prevent ejection of ink to a position protruding from the recording medium, while allowing image recording on the whole area of the recording medium. Further, also when the image recording region is a region left after formation of margins in prescribed widths on the top, bottom, left and right of the recording medium (frame-existing recording), it is possible to set the margins to have fixed widths (the line of the end edge of the recording medium is in parallel to the ink-ejection starting position along the conveying direction (sub-scanning direction) with an empty space therebetween).

Further, according to this recording apparatus, also when the end edge of the recording medium is inclined to the conveying direction due to the shape of the recording medium itself (e.g. the shape of the recording medium is trapezoidal), similarly to the above case, it is possible to prevent ejection of ink to a position protruding from recording paper, while allowing image recording on the whole area of the recording medium.

Furthermore, according to this recording apparatus, it is not required to perform the complicated process for rotationally converting image data, thereby enabling prevention of increases in cost and process time.

It should be noted that the inclination detecting unit may detect the degree of inclination of only one side end edge of the recording medium in the scanning direction, or the degrees of inclination of both-side end edges of the recording medium in the scanning direction may be detected. If assumed that the shape of a recording medium is previously grasped, even in the former configuration where the degree of inclination of only one side end edge of the recording medium in the scanning direction is detected, the degree of inclination of the other side end edge thereof can be estimated. However, in terms of a recording medium having a shape not previously grasped, the degree of inclination of the other side end edge of the recording medium cannot be estimated from the degree of inclination of the one side end edge thereof. In order to also deal with such a recording medium, it is preferable to employ the latter configuration where the degrees of inclination of both-side end edges of the recording medium in the scanning direction are detected.

Subsequently, a recording method according to a second aspect is to eject ink from a plurality of nozzles, to the recording medium conveyed by the conveying unit based upon image data representing an image, while scanning the ink ejection unit having the nozzles in a scanning direction orthogonal to a conveying direction of the recording medium, to record the image represented by the image data on the recording medium.

This recording method is characterized by comprising the steps of: detecting the degree of inclination of the end edge of the recording medium conveyed by conveying unit, the end edge being along the conveying direction, to the conveying direction; and controlling an ink-ejection starting position and an ink-ejection ending position of each of the nozzles in a scanning direction at the time of image recording on the recording medium, according to the detected degree of inclination.

Therefore, according to this recording method, it is possible to obtain a similar effect to the effect described regarding the recording apparatus according to the first aspect.

The above and further objects and features will more fully be apparent from the following detailed description with accompanying drawings.

DETAILED DESCRIPTION OF THE EXEMPLARY EMBODIMENTS

In the following, the present embodiment is described using the drawings.

Figure 1:
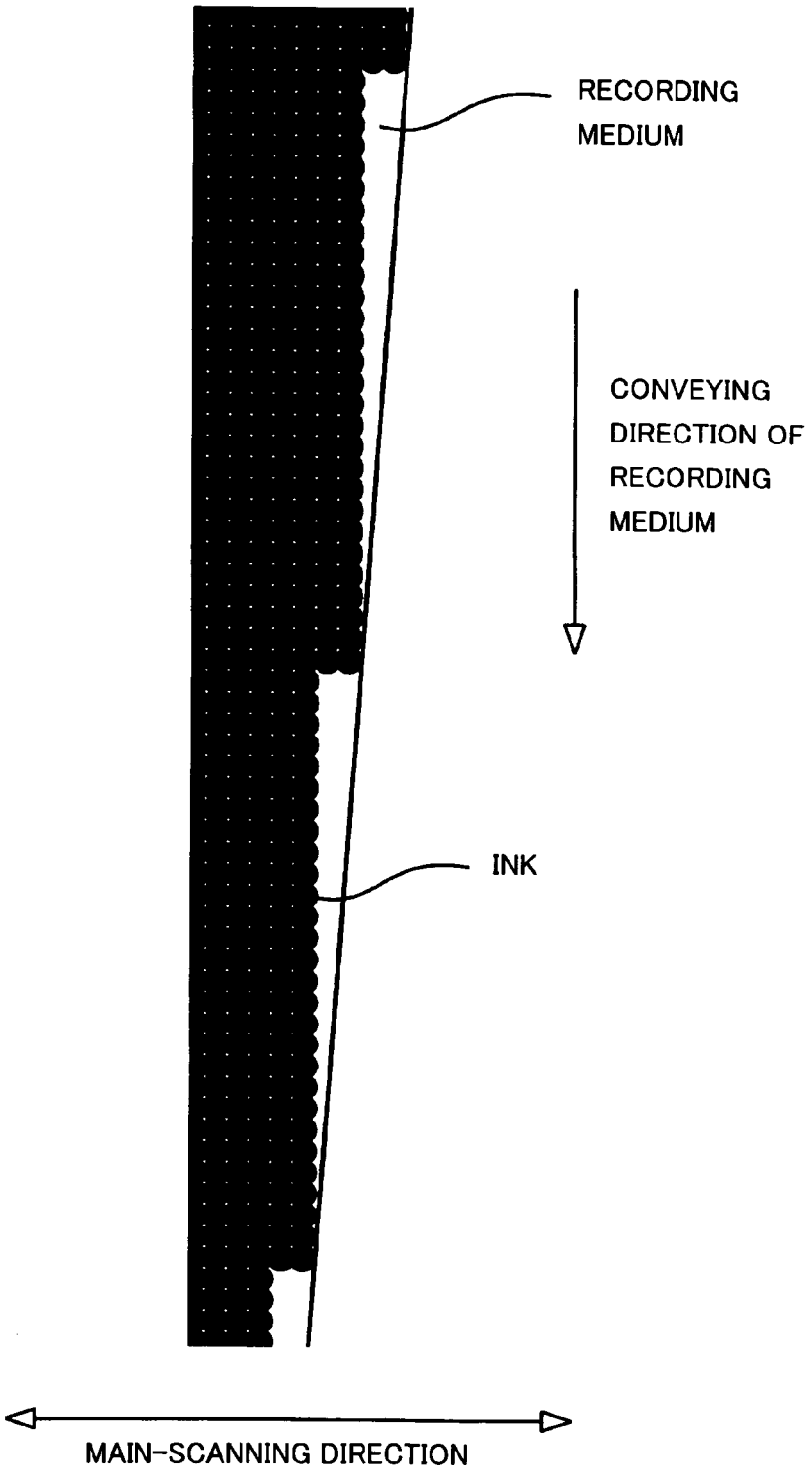
FIG. 1 is an explanatory view showing a recording state of the end edge of a recording medium in the case of making recording such that ink does not protrude from the inclined recording medium.
Figure 2:
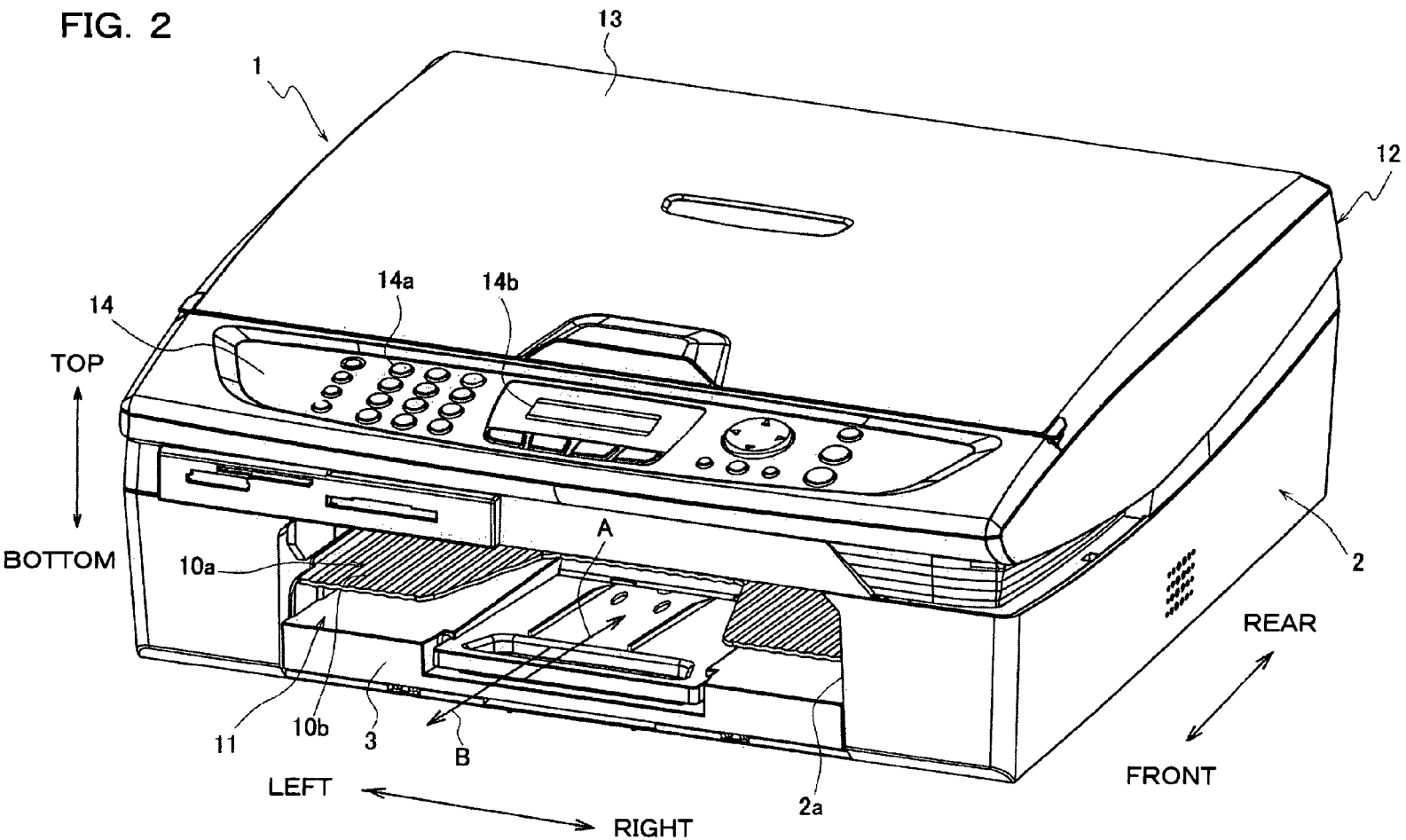
FIG. 2 is a perspective view of a multi-functional device of an embodiment.

FIG. 2 is a perspective view of a multi-functional device (MFD: Multi Functional Device) 1 of the embodiment, and FIG. 3 is a side-sectional view thereof.

The multi-functional device 1 has a printer function, a copy function, a scanner function and a facsimile function. As shown in FIGS. 2 and 3, an image reading device 12 used for reading a document is provided on the top of a housing 2 made of a synthetic resin.

The image reading device 12 is configured in a vertically openable and rotatable manner around a pivot (not shown) provided at the left end of the image reading device 12, with respect to a housing 2. Further, a document cover body 13 which covers the upper face of the image reading device 12 is placed in a vertically openable and rotatable manner around a pivot 12*a* (cf. FIG. 3) provided at the rear end of the document cover body 13, with respect to the image reading device 12.

Figure 3:
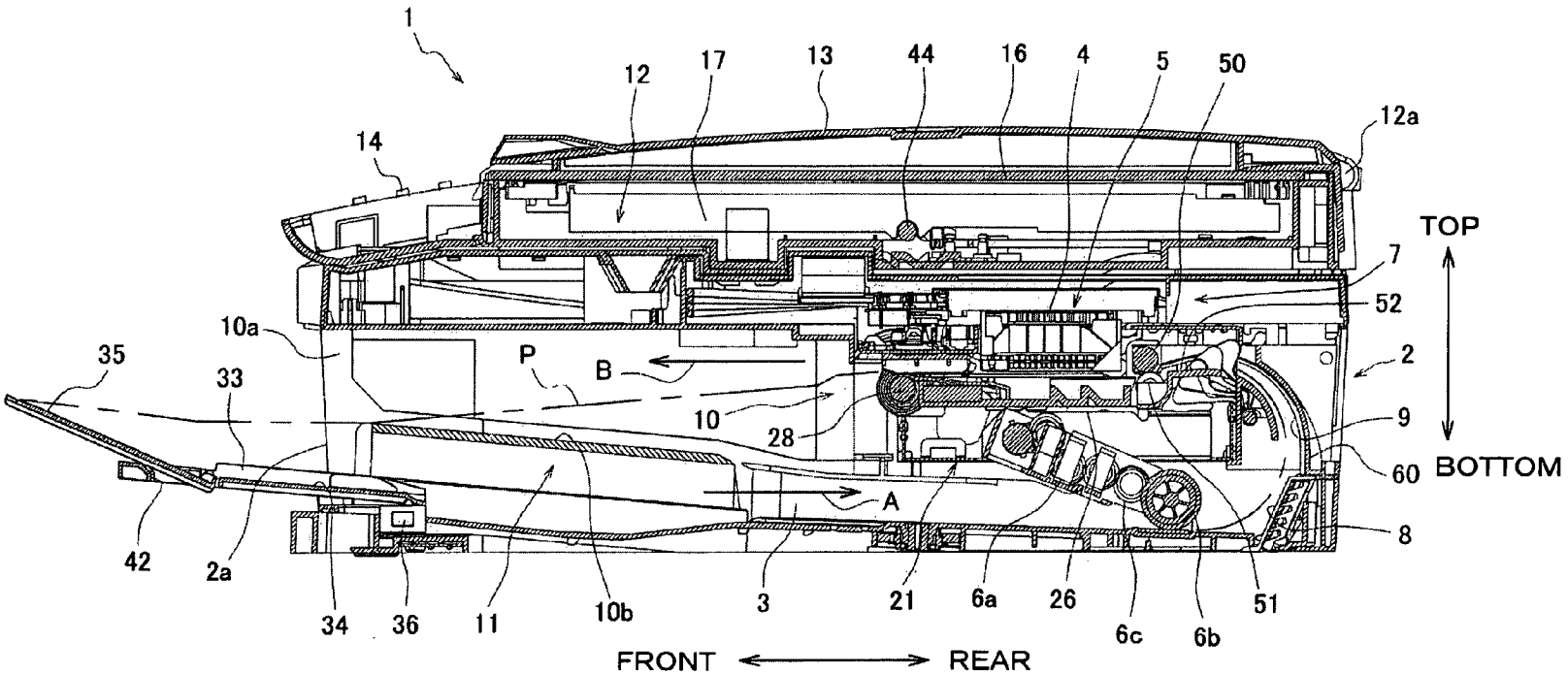
FIG. 3 is a side-sectional view of the multi-functional device of the embodiment.

As shown in FIG. 3, a glass plate 16 for placement is provided for placing a document that is to be read after opening of the upper side of the document cover body 13 on the upper face of the image reading device 12. Under the glass plate 16 for placement, an image scanner (CIS: Contact Image Sensor) 17 for document reading is provided along a guide shaft 44 extending in a direction orthogonal to paper of FIG. 3 (horizontal direction) so as to reciprocate.

Further, as shown in FIGS. 2 and 3, an operational panel unit 14, comprising an operational button group 14*a* for performing an input operation and a liquid crystal display unit (LCD) 14*b* for displaying a variety of information, is provided ahead of the image reading device 12.

In the meantime, a paper feed unit 11 for feeding recoding paper P as the recording medium is provided on the bottom of the housing 2. In the paper feed unit 11, a paper feed cassette 3 for housing the recording paper P in a laminated (stacked) state is detachably provided in a cross direction with respect to the housing 2 via an opening 2*a* formed on the front side of the housing 2. In this embodiment, the paper feed cassette 3 is configured to be capable of housing a plurality of laminated (stacked) sheets of the recording paper P of an A-4 size, a letter size, a regal size, a postcard size, or the like, with the short side (width) thereof extending in a direction (main-scanning direction, horizontal direction) orthogonal to the paper feeding direction (sub-scanning direction, cross direction, direction of the arrow A).

As shown in FIG. 3, an inclined separation plate 8 for separating recording paper is arranged on the back side (rear end side) of the paper feed cassette 3. The inclined separation plate 8 is formed in a projection curved shape as viewed from a plane so as to protrude in the midsection in the width direction (horizontal direction) of the recording paper P, and gradually retract toward both the left and right ends in the width direction of the recording paper P. A saw-tooth elastic separation pad is provided in the midsection in the width direction of the recording paper P for promoting separation by abutting against the head of the recording paper P.

Further, a base-end of a paper feed arm 6*a* for feeding the recording paper P from the paper feed cassette 3 is vertically rotatably placed in the paper feed unit 11 on the housing 2 side. A rotation driving force is transmitted from an LF (conveyance) motor 131 (cf. FIG. 6) to a paper feed roller 6*b* provided at the head of the paper feed arm 6*a* by a gear transmission mechanism 6*c* provided in the paper feed arm 6*a*. Each sheet of the recording paper P stacked in the paper feed cassette 3 is separately conveyed with use of the paper feed roller 6*b* and the foregoing elastic separation pad of the inclined separation plate 8. In this manner, each sheet of the recording paper P separated so as to proceed along the paper feeding direction (the direction of the arrow A) is conveyed to a recording unit 7 provided above (on a position higher than) the paper feed cassette 3 via a feeding path 9 including a sidewise, U-shaped pass formed in a space between a first conveyance path body 60 and a second conveyance path body 52.

Figure 4:
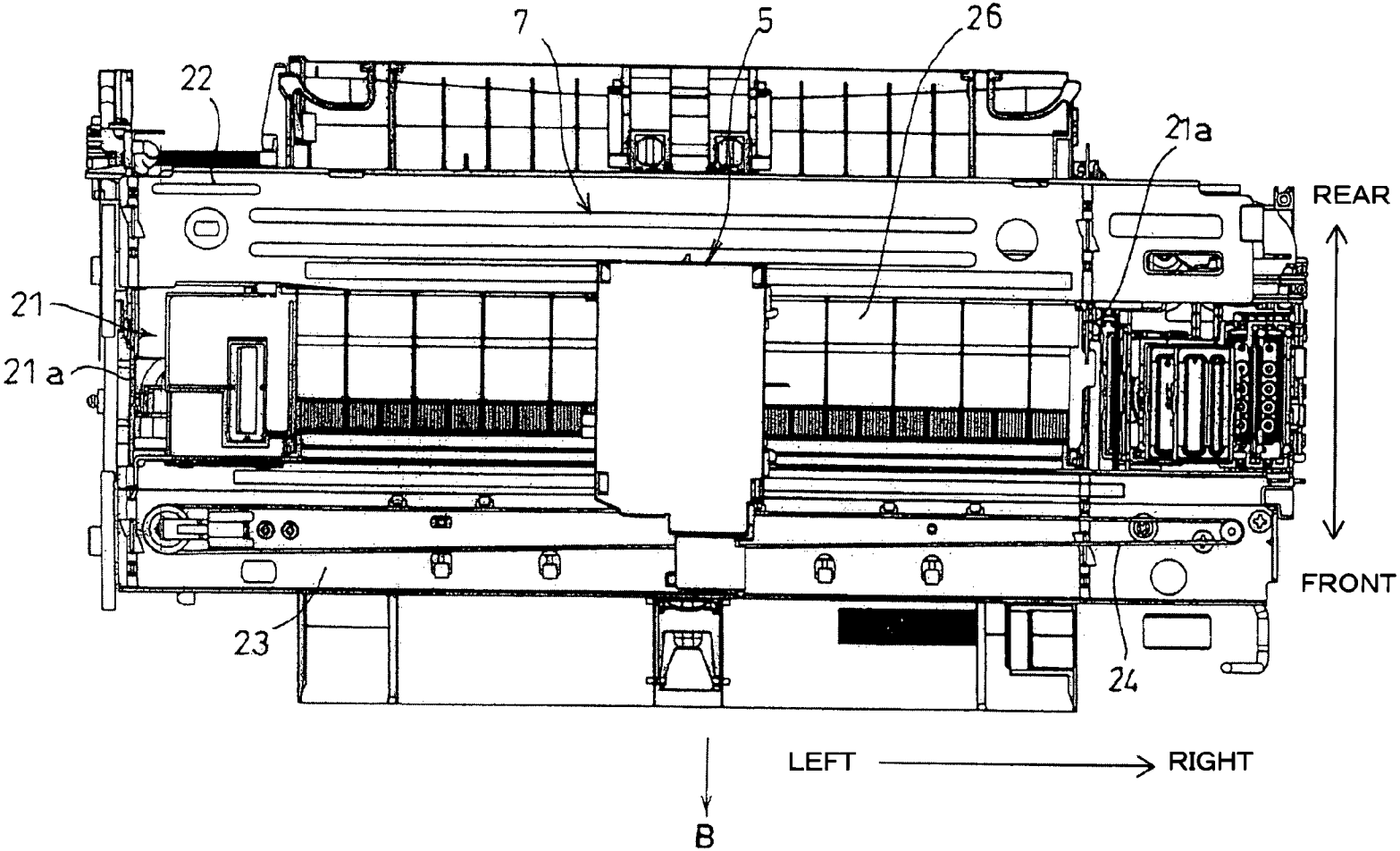
FIG. 4 is a plan view of the multi-functional device in a state where an image reading device is omitted.

FIG. 4 is a plan view of the multi-functional device 1 in a state where the image reading device 12 is omitted.

As shown in FIG. 4, the recording unit 7 is provided between a main frame 21 formed in an upwardly opened box shape and a first guide member 22 and a second guide member 23 in horizontally platy shape which are supported by a pair of left and right side plates 21*a* and extend in the horizontal direction (main-scanning direction). The recording unit 7 comprises an inkjet-type recording head 4 (cf. FIGS. 3 and 5) for recording an image on the recording paper P by ejecting ink from the lower face thereof, and a carriage 5 equipped with the recording head 4.

The carriage 5 is slidably supported astride the first guide member 22 and the second guide member 23 respectively arranged on the upstream side and on the downstream side in the paper discharging direction (direction of the arrow B), and the carriage 5 is provided so as to reciprocate in the horizontal direction. In order to reciprocate the carriage 5, on the upper face of the second guide member 23 arranged on the downstream side in the paper discharging direction (the direction of the arrow B), a timing belt 24 is wound so as to extend in the main-scanning direction (horizontal direction), and a CR (carriage) motor 132 (cf. FIG. 6) for driving the timing belt 24 is fixed to the lower face of the second guide member 23.

Meanwhile, on a recording unit 7, below the lower face of the recording head 4 in the carriage 5, a flat platen 26, extending in the horizontal direction while opposed to the recording head 4, is fixed to the main frame 21 between the two guide members 22, 23.

As shown in FIG. 3, a drive roller 50 and a nip roller 51 are arranged on the upstream side of the platen 26 in the paper discharging direction (direction of the arrow B). The drive roller 50 serves as a conveyance (resist) roller for conveying the recording paper P to the lower face of the recording head 4. The nip roller 51 is placed below the drive roller 50 while opposed thereto. Further, a paper discharge roller 28 and a spur roller (not shown) are arranged on the downstream side of the platen 26 in the paper discharging direction (direction of the arrow B). The paper discharge roller 28 is driven so as to convey the recording paper P, having been conveyed via the recording unit 7, to a paper discharge unit 10 along the paper discharging direction (direction of the arrow B). The spur roller is biased to the paper discharge roller 28 side while opposed thereto.

The recording paper P on which recording was made in the recording unit 7 is discharged with the recorded face turned upward to the paper discharge unit 10. The paper discharge unit 10 is arranged above the paper feed unit 11, and a paper discharge outlet 10*a* is open in common with the opening 2*a* of the front face of the housing 2. The recording paper P discharged from the paper discharge unit 10 following the paper discharging direction (direction of the arrow B) are stacked and housed in a paper discharge tray 10*b* positioned on the inner side of the opening 2*a*.

In the meantime, an ink storage unit (not shown) is provided at the front right end position of the housing 2 covered with the image reading device 12. In the ink storage unit, four ink cartridges, respectively housing ink of four different colors (black (Bk), cyan (C), yellow (Y), magenta (M)) for full-color recording, are placed so as to be detachable in a state where the image reading device 12 is upwardly opened. The ink cartridges of the respective colors are connected to the foregoing recording head 4 with four ink supply tubes having flexibility. The ink housed in the respective ink cartridges are supplied to the recording head 4 through the respective ink supply tubes.

Figure 5:
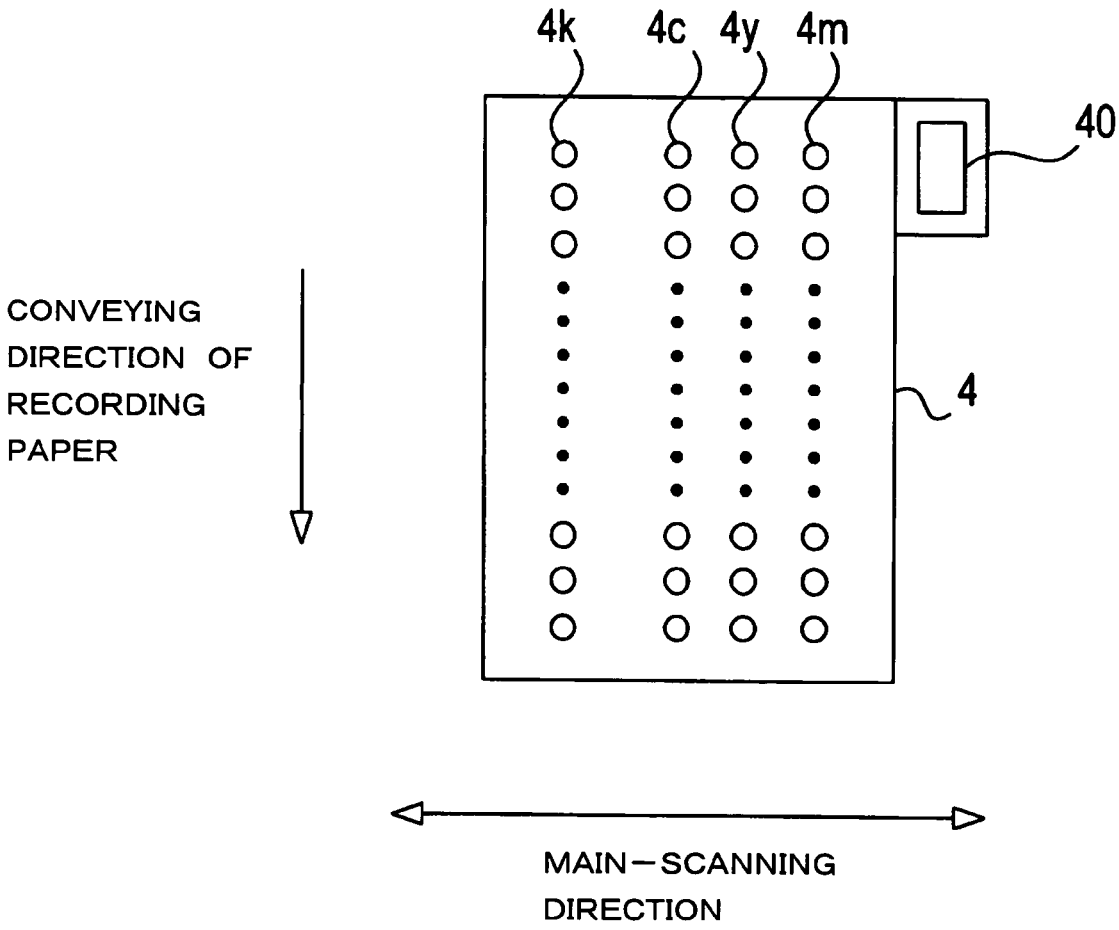
FIG. 5 is a pattern view of a recording head seen from the bottom face thereof.

FIG. 5 is a pattern view of the recording head 4 seen from the bottom face thereof.

As shown in FIG. 5, nozzle arrays 4*k*, 4*c*, 4*y*, 4*m* are provided, each of the arrays being composed of a plurality of nozzles arranged along the conveying direction of the recording paper P (paper discharging direction, sub-scanning direction) on the recording head 4. Specifically, in correspondence to the ink of four different colors (black (Bk), cyan (C), yellow (Y), magenta (M)) for full-color recording, the four nozzle arrays 4*k*, 4*c*, 4*y*, 4*m* which eject ink of the respective colors are arranged in parallel. It is noted that the nozzles may be arranged at a slant with respect the conveying direction.

Further, a media sensor 40 capable of detecting the end edge (end edge along the conveying direction) of the recording paper P in the width direction (horizontal direction) is attached to the recording head 4. The media sensor 40 is an optical sensor (reflective sensor) having a light-emitting element (e.g. light-emitting diode) and a light-receiving element (e.g. phototransistor). In the media sensor 40, a reflected light made by light emission of the light-emitting element is received in the light-receiving element so that the presence of the recording paper P below the media sensor 40 is detected.

Next described is a configuration of a control system of the multi-functional device 1 according to the this embodiment.

Figure 6:
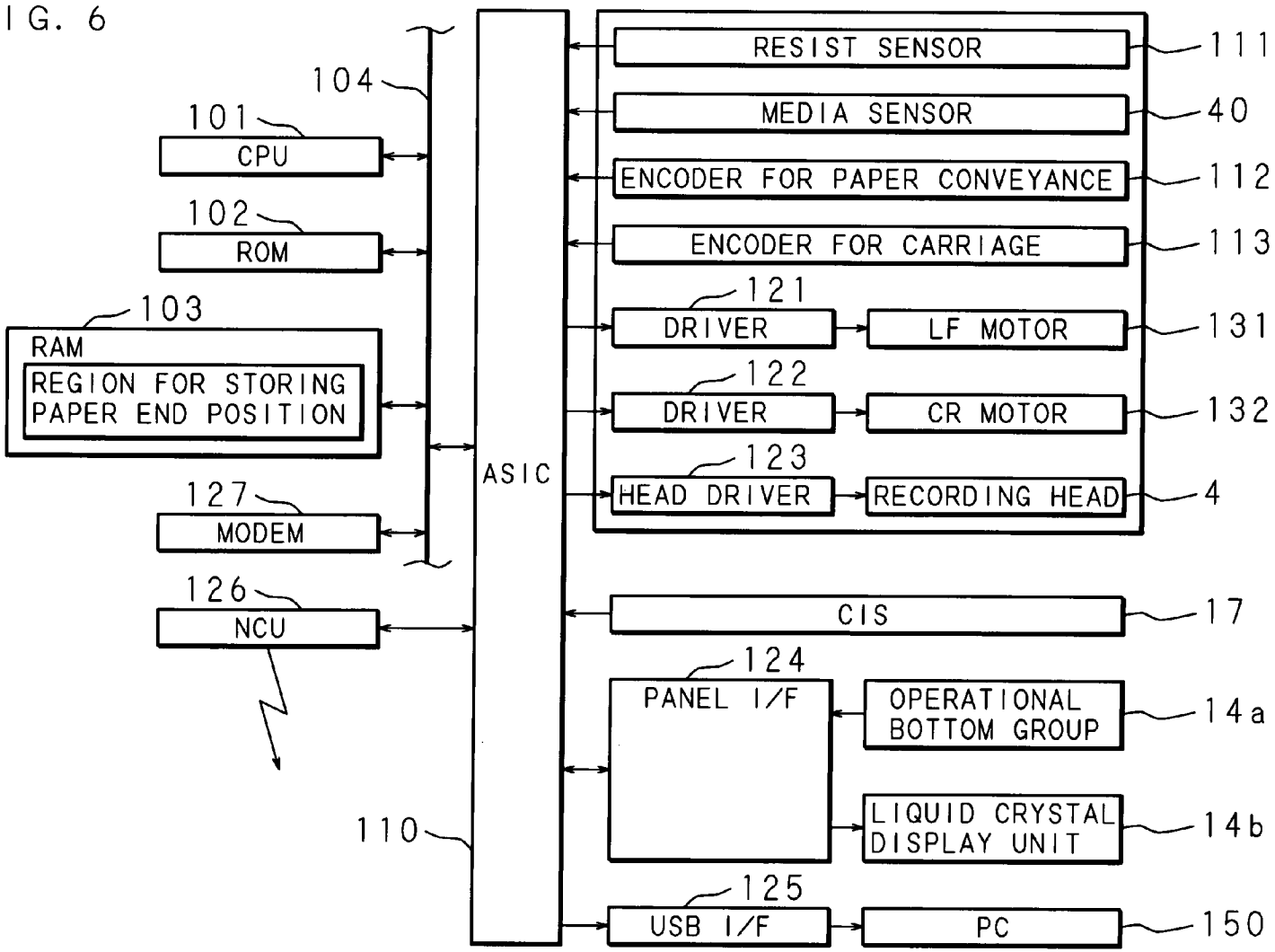
FIG. 6 is a block diagram representing a configuration of a control system of the multi-functional device.

FIG. 6 is a block diagram representing a configuration of the control system of the multi-functional device 1.

As shown in FIG. 6, the control system is mainly composed of a microcomputer comprising a CPU 101, a ROM 102, a RAM 103, and a bus 104 for connecting those unit and memories. Further, the bus 104 is connected to ASIC (Application Specific Integrated Circuit) 110 for not only taking in information from various sensors and processing it rapidly, but also driving and controlling various actuators.

To the ASIC 110 connected are a resist sensor 111 for detecting a position to which the recording paper P has been fed, the foregoing media sensor 40, an encoder 112 for paper conveyance for detecting a rotation amount of the drive roller 50, and an encoder 113 for carriage for detecting a shifting amount of the carriage 5.

Further, to the ASIC 110, a driver 121, a driver 122, and a head driver 123 are connected. The driver 121 drives an LF motor 131 as a driving source for rotationally driving the foregoing the paper feed roller 6*b*, the drive roller 50 and the paper discharge roller 28, to convey the recording paper P. The driver 122 drives a CR motor 132 to shift the carriage 5 equipped with the recording head 4 in the main-scanning direction (horizontal direction). The head driver 123 drives the recording head 4 to selectively eject ink to the recording paper P at a prescribed timing.

Meanwhile, the foregoing image scanner (CIS) 17 is connected to the ASIC 110. An image data of a document, having been read by the image scanner 17, is inputted into the ASIC 110.

A panel interface (panel I/F) 124 is further connected to the ASIC 110. The panel interface 124 inputs a command from the user, which has been inputted from the operational button group 14*a* of the operational panel unit 14 to the ASIC 110, to display various messages in the liquid crystal display unit 14*b* of the operational panel unit 14 according to the display command from the ASIC 110.

Moreover, a USB interface (USB I/F) 125, an NCU (Network Control Unit) 126 and the like are connected to the ASIC 110. The USB interface 125 communicates with a personal computer (PC) 150 through a USB cable. The NCU (Network Control Unit) 126 communicates with the personal computer 150 through a public communication network such as a telephone line. To the NCU 126, a modem 127 is connected which demodulates a communication signal inputted from the PSTN (public switched telephone network) into the NCU 126, and also modulates data, to be transmitted to the outside by facsimile transmission or the like, into a communication signal.

In the multi-functional device 1 of the this embodiment as thus configured, a printer function, a copy function, a scanner function and a facsimile function are realized by the operations of the CPU 101 and ASIC 110.

For example, in the case of recording an image on the recording paper P in the printer function, the copy function and the facsimile function, first, the LF motor 131 is driven to rotate the paper feed roller 6*b* so as to feed the recording paper P from the paper feed cassette 3. At this time, the drive roller 50 and the paper discharge roller 28 are configured so as to rotate in a direction reversed to the direction (conveying rotation direction) in which the recording paper P is conveyed to the paper discharge side. The head of the recording paper P conveyed by the paper feed roller 6*b* abuts against the conveyance (resist) roller comprising the drive roller 50 and the nip roller 51, to correct the inclination of the recording paper P. Subsequently, the rotation driving force transmission path from the LF motor 131 to the paper feed roller 6*b* is brought into a non-transmitting state, and thereby, the rotation of the paper feed roller 6*b* is stopped. Further, the rotation of the LF motor 131 is switched to be reversed for rolling the driver roller 50 and the paper feed roller 28 in the conveying rotation direction, thereby to feed the recording paper P to the recording unit 7. On the recording paper P supplied to the recording unit 7 in the above-mentioned manner, ink is ejected from each of the nozzle arrays 4*k*, 4*c*, 4*y*, 4*m* of the recording head 4 based upon image data representing an image, while scanning the carriage 5 equipped with the recording head 4 in the main-scanning direction (horizontal direction). Such an operation for recording part of the image in strip shape and the operation for conveying the recording paper P in prescribed amount are alternately repeated to record the image represented by the image data on the recording medium. Upon completion of image recording on the recording paper P, the recording paper P is discharged into the paper discharge tray 10*b* by the rotation of the paper discharge roller 28.

Incidentally, for example in the case of performing frameless recording, when the recording paper P in an inclined state is fed to the recording unit 7, there may occur a problem of occurrence of a portion on the recording paper P to which ink is not ejected and a problem of ejection of ink to a position protruding from the recording paper P.

Figure 7:
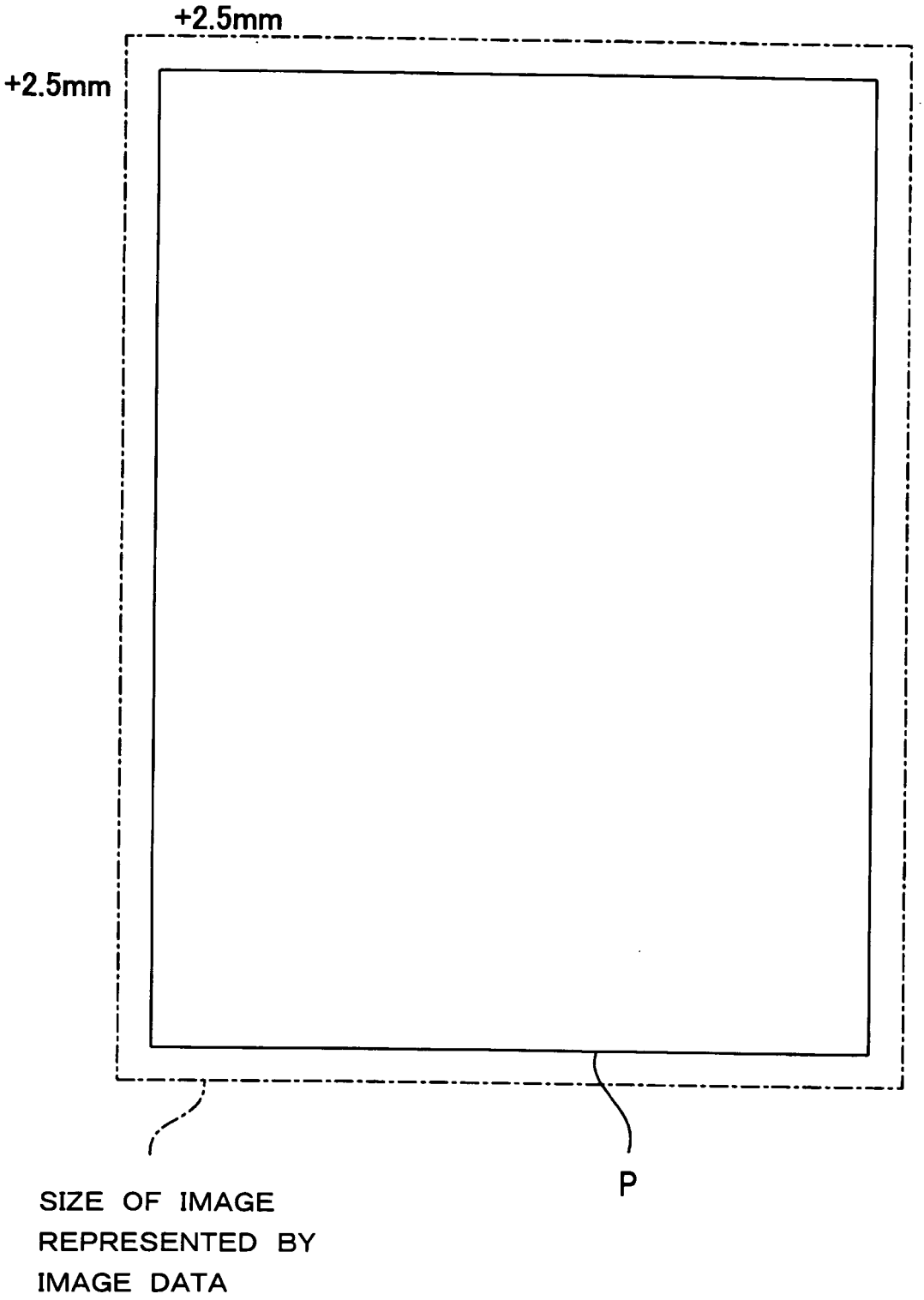
FIG. 7 is an explanatory view for explaining a size of an image represented by image data.
Figure 8:
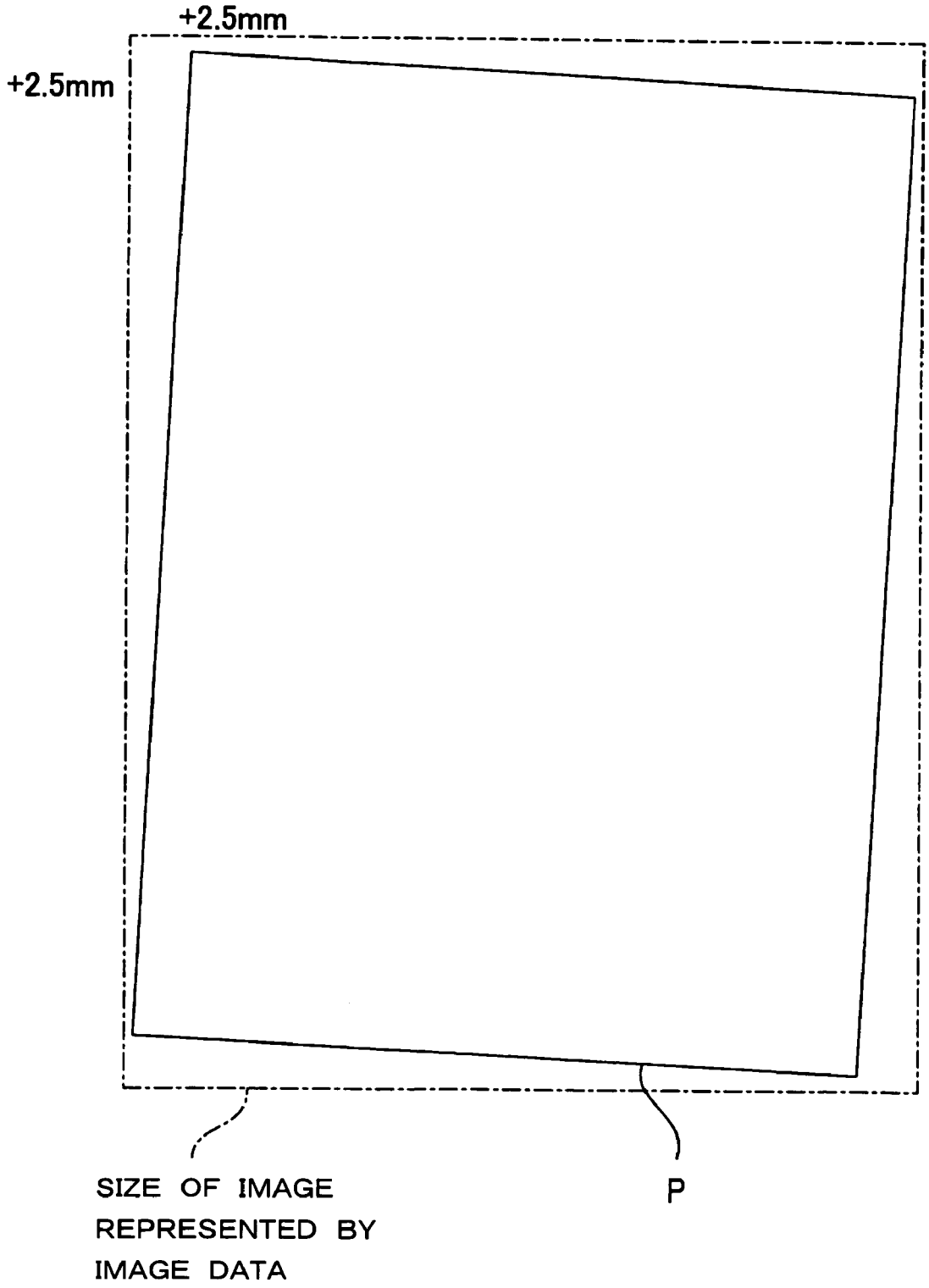
FIG. 8 is an explanatory view showing the positional relation between the image represented by the image data and inclined recording paper.

Therefore, in the multi-functional device 1 of the this embodiment, as shown in FIG. 7, image data is used which represents an image having a size extended by 2.5 mm in the top, bottom, left and right directions from (image slightly larger than) an image recording region (FIG. 7 is an example of the frameless recording, and the whole area of the recording paper P is the image recording region) as a region of the recording paper P where an image is to be recorded. By using the image data representing the image having a size extended in this manner, as shown in FIG. 8, even when the recording paper P is conveyed in a state inclined in some degree, the image is recordable over the image recording region. However, if the image represented by the image data is recorded as it is, ink is undesirably ejected also to the position protruding from the image recording region. Thus the degree of inclination of the end edge, along the conveying direction, of the recording paper P conveyed to the recording unit 7, to the conveying direction is detected. Based upon the detection result, an ink-ejection starting position and an ink-ejection ending position are controlled, thereby to eject ink only for a portion of the image represented by the image data which is to be recorded in the image recording region.

In the following, the print process performed by the CPU 101 of the multi-functional device 1 for realizing the control as described above is described using a flowchart of FIG. 9. This print process is started by input of a print start signal. It should be noted that the print start signal is inputted for example in a print starting operation with the personal computer 150, a document copy starting operation in the operational panel unit 14, reception of facsimile data, and the like.

When the print process is started, first, a paper feed process is performed where the recording paper P is fed from the paper feed cassette 3 to the recording unit 7 in S101. It is to be noted that a specific description of the paper feed process (sub-routine shown in FIG. 10) is given later.

Subsequently, in S102, the following printing process is performed. Ink is ejected from the nozzle arrays 4*k*, 4*c*, 4*y*, 4*m* of the recording head 4 based upon image data representing an image, while scanning the carriage 5 equipped with the recording head 4 in the main-scanning direction, to record (print) part of the image in strip shape. It is to be note that a specific description of the printing process (sub-routine shown in FIG. 12) is described later.

Subsequently, in S103, it is determined whether or not image recording by one page is completed.

When it is determined in S103 that the image recording corresponding to one page has not been completed, the process is shifted to S104. After a conveying process for conveying the recording paper P in prescribed amount (amount according to print resolution), the process is returned to S102. Namely, the print process and the conveying process are alternately repeated until image recording corresponding to one page is completed. It should be note that a specific description of the conveying process (sub-routine shown in FIG. 13) is given later.

On the other hand, when it is determined in S103 that the image recording corresponding to one page has been completed, the process is shifted to S105, and a paper discharge process is performed for discharging the recording paper P into the discharge paper tray 10*b* of the paper discharge unit 10.

Subsequently, in S106, it is determined whether or not succeeding data is present.

When it is determined in S106 that the succeeding data is present, the process is returned to S101 and the foregoing process (S101 to S105) is performed.

On the other hand, when it is determined in S106 that the succeeding data is not present, this print process is completed.

Figure 9:
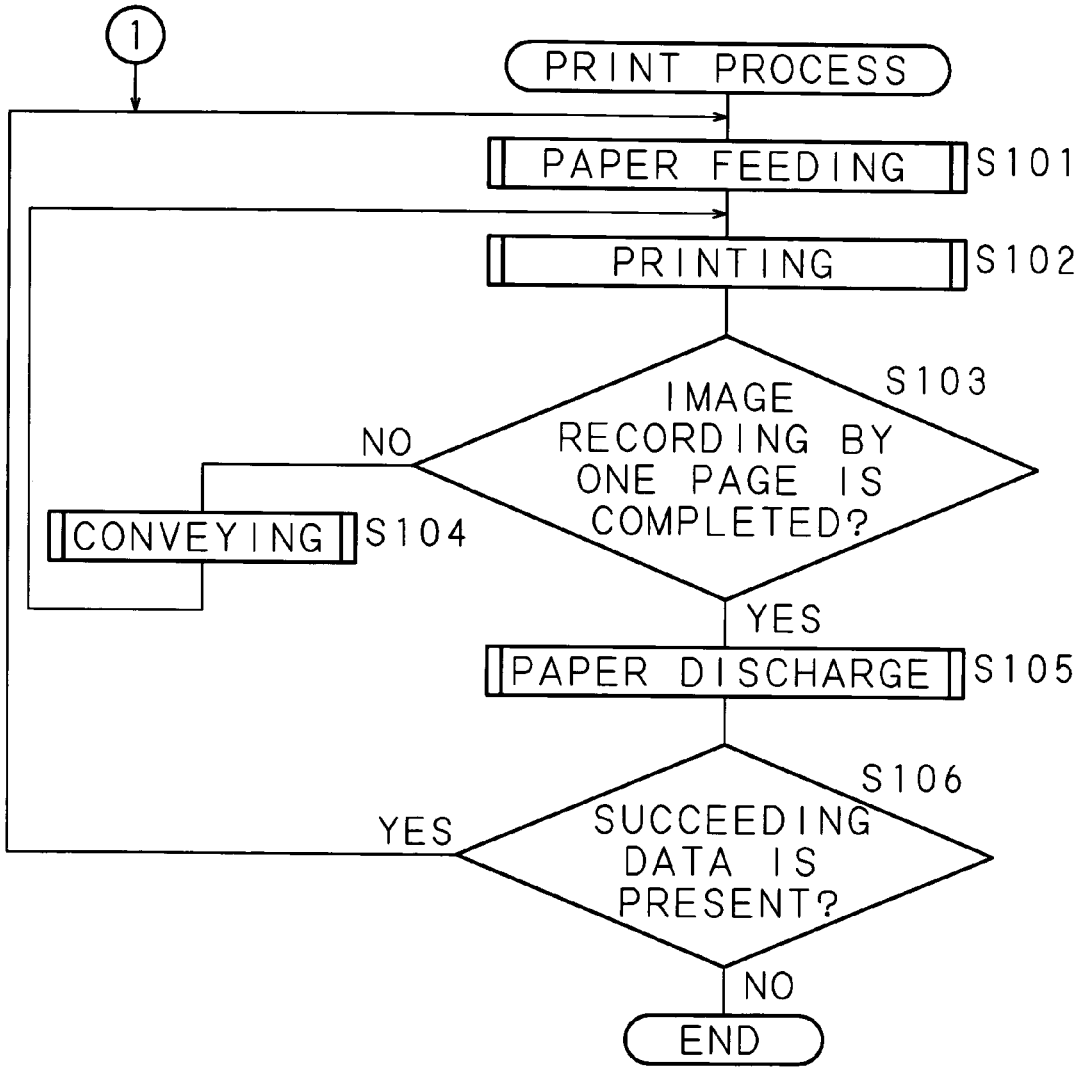
FIG. 9 is a flowchart for a print process.
Figure 10:
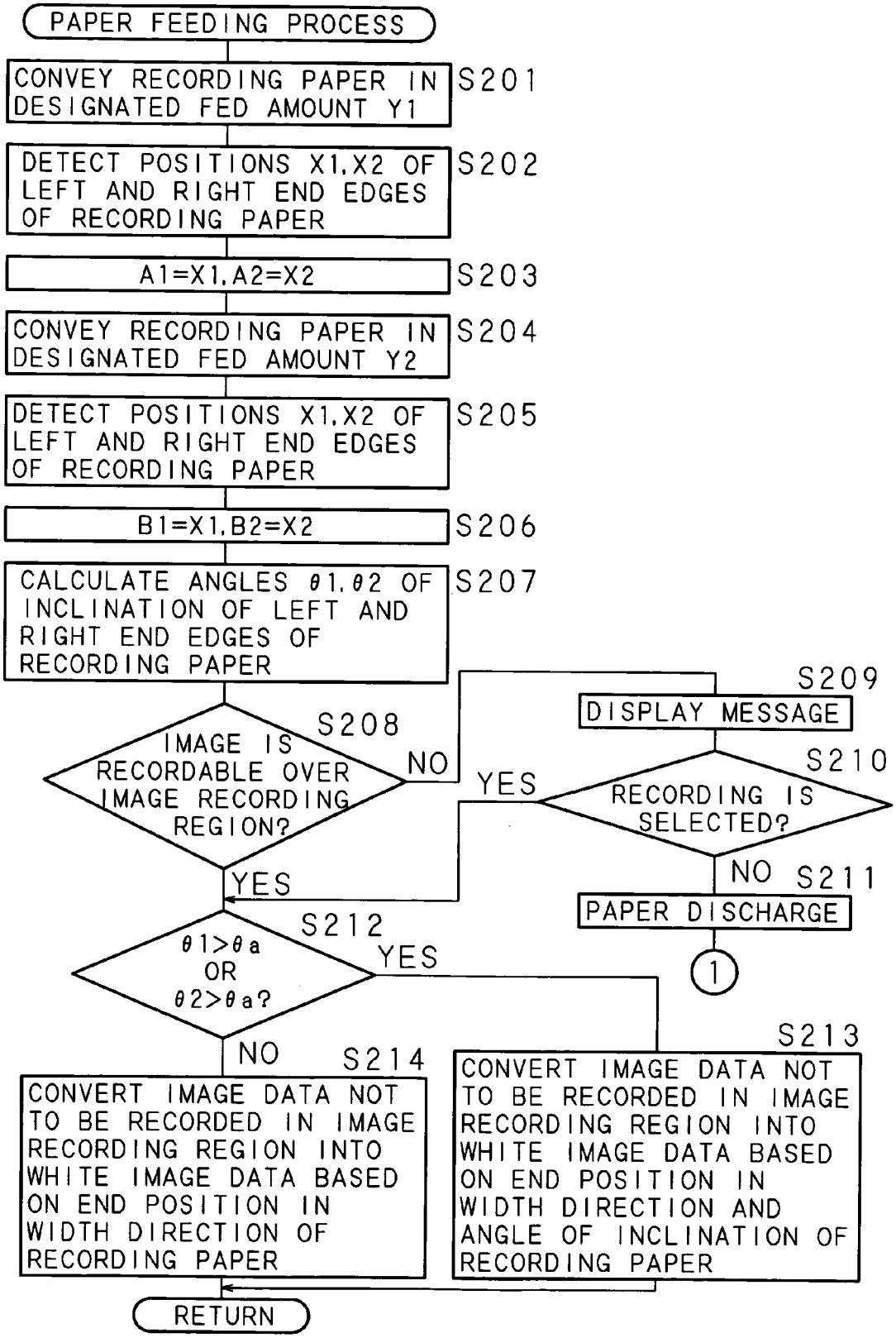
FIG. 10 is a flowchart for a paper feeding process.

Next, the paper feed process executed in S101 in the print process (FIG. 9) is described using a flowchart of FIG. 10.

When the paper feed process is started, first in S201, the recording paper P is fed from the paper feed cassette 3 to perform a process for conveying the recording paper P just in designated fed amount Y1. Specifically, the recording paper P is conveyed to a position which is upstream from the conveyance position for staring image recording on the recording paper P and in which the head of the recording paper P crosses over the media sensor 40. It should be noted that a conveyance amount of the recording paper P is determined based upon a detected value of the encoder 112 for paper conveyance.

Subsequently, in S202, a position X1 of the left-side end edge of the recording paper P and a position X2 of the right-side end edge of the recording paper P are detected (positions on the lower chain double-dashed line in FIG. 11). Specifically, the left and right end positions of the recording paper P are detected by monitoring a detected value of the media sensor 40 while scanning the carriage 5 equipped with the recording head 4 in the main-scanning direction. It should be noted that the left-side end edge position X1 and the right-side end edge position X2 are determined based upon a detected value of the encoder 113 for carriage.

Next, in S203, the left-side end edge position X1 and the right-side end edge position X2, detected in S202, are respectively substituted into variables A1, A2 (parameters for storing the left and right side end positions detected last time) for use in a later-described process for calculating angles θ1, θ2 of inclination. Specifically, the positions are stored in a region for storing a paper end position in the RAM 103.

Next, in S204, a process for conveying the recording paper P just in designated fed amount Y2 is performed. Specifically, the recording paper P is conveyed to a conveyance position for staring image recording on the recording paper P.

Figure 11:
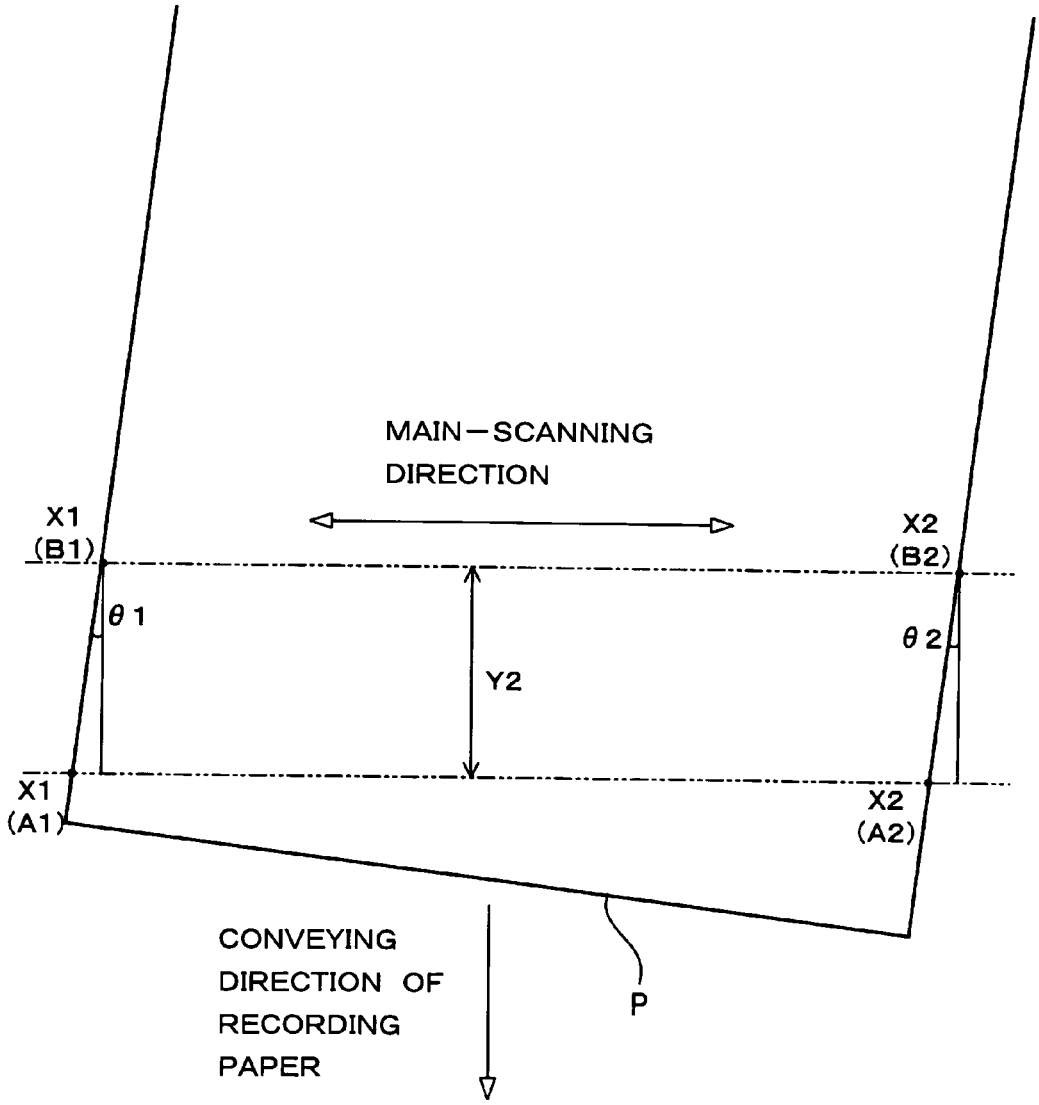
FIG. 11 is an explanatory view for explaining a method for calculating degrees of inclination of the left and right end edges of recording paper.

Next, in S205, as in the process of S202, the position X1 of the left-side end edge of the recording paper P and the position X2 of the right-side end edge of the recording paper P are detected (positions on the upper chain double-dashed line in FIG. 11).

Next, in S206, the left-side end edge position X1 and the right-side end edge position X2, detected in S205, are respectively substituted into variables B1, B2 (parameters for storing the left and right side end positions detected this time) for use in a later-described process for calculating angles θ1, θ2 of inclination. Specifically, the positions are stored in the region for storing a paper end position in the RAM 103.

Next, in S207, the process is performed for respectively calculating the angles θ1, θ2 of inclination of the left and right end edges of the recording paper P (cf. FIG. 11). Specifically, the angles θ1, θ2 of inclination are respectively calculated from the following expression (1) and (2) based upon the variables A1, A2, B1, B2 and the conveyance amount Y2 of the recording paper P in S204.

$$\theta 1=\arctan((A1-B1)/Y2) \quad \text{Expression (1)}$$

$$\theta 2=\arctan((A2-B2)/Y2) \quad \text{Expression (2)}$$

Subsequently, in S208, based upon the angles θ1, θ2 of inclination which were calculated in S207, and the variables A1, A2, B1, B2, the positional relation between the image recording region of the recording paper P and a region where image represented by image data is to be recorded is determined, to determine whether or not the image represented by the image data is recordable over the image recording region of the recording paper P.

When it is determined in S208 that the image represented by the image data is not recordable over the image recording region of the recording paper P, the process is shifted to S209. A message of contents: "A normal recording cannot be made due to defective conveyance of the recording paper P. Should recording continue?" is displayed on the crystal liquid display unit 14*b* of the operational panel unit 14 for urging an operation for inputting whether or not to continue recording.

Subsequently, in S210, it is determined whether or not the input operation, performed with the operational button group 14*a* of the operational panel unit 14 in response to the display in S209, is an input operation for continuation of recording.

When it is determined in S210 that the input operation is not for continuation of recording (input operation for non-continuation of recording), the process is shifted to S211. After the paper discharge process has been performed for discharging the recording paper P into the paper discharge tray 10*b* of the paper discharge unit 10, the process is shifted to the process of S101 in the print process (FIG. 9). Namely, when the image represented by the image data is not recordable over the image recording region of the recording paper P due to a large degree of inclination of the recording paper P or some other reason, and also when the user's intention not to continue recording is indicated, the recording paper P is discharged and new recording paper P is fed.

On the other hand, when it is determined in S210 that the input operation is for continuation of recording, the process is shifted to S212.

Further, also when it is determined in S208 that the image represented by the image data is recordable over the image recording region of the recording paper P, the process is shifted to S212.

In S212, it is determined whether or not at least one of the angles θ1, θ2 of inclination is larger than a standard angle θa of inclination. Here, the standard angle θa of inclination is an angle to serve as a standard for determination as to whether or not the degree of inclination is minute. When the angles θ1, θ2 of inclination are not larger than the standard angle θa of inclination, it is then determined that the degree of inclination of the recording paper P is minute (can be considered not to be inclined).

When it is determined in S212 that at least one of the angles θ1, θ2 of inclination is larger than the standard angle θa of inclination, the process is shifted to S213, and a conversion process is performed on image data corresponding to one band to be recorded on the recording paper P in a printing process (S102) as a next process. Specifically, based upon the angles θ1, θ2 of inclination and the variables A1, A2, B1, B2, the portions of the image represented by the image data which is not to be recorded in the image recording region of the recording paper P is determined. Then, the image data conversion process for converting a color of the portion not to be recorded into a color (white in this embodiment) of ink that is not to be ejected. Thereby, the ink-ejection starting position and the ink-ejection ending position of each of the nozzles in each of the nozzle arrays 4*k*, 4*c*, 4*y*, 4*m* in the scanning direction are made different along the angles θ1, θ2 of inclination. Thereafter, this paper feed process is completed.

On the other hand, when it is determined in S212 that both the angles θ1, θ2 of inclination are not larger than the standard angle θa of inclination, the process is shifted to S214, and a conversion process is performed on image data corresponding to one band to be recorded on the recording paper P in the printing process (S102) as a next process. Specifically, the angles θ1, θ2 of inclination are regarded as zero, and the variables B1, B2 are regarded as the respective ends of the recording paper P in the scanning direction. A portion of the image represented by the image data which is not to be recorded in the image recording region of the recording paper P is determined, and the image data conversion process for converting a color of the portion not to be recorded into white. Thereby, the ink-ejection starting position and the ink-ejection ending position of each of the nozzles in each of the nozzle arrays 4*k*, 4*c*, 4*y*, 4*m* in the scanning direction are made the same along the angles θ1, θ2 of inclination. Thereafter, this paper feed process is completed.

Figure 12:
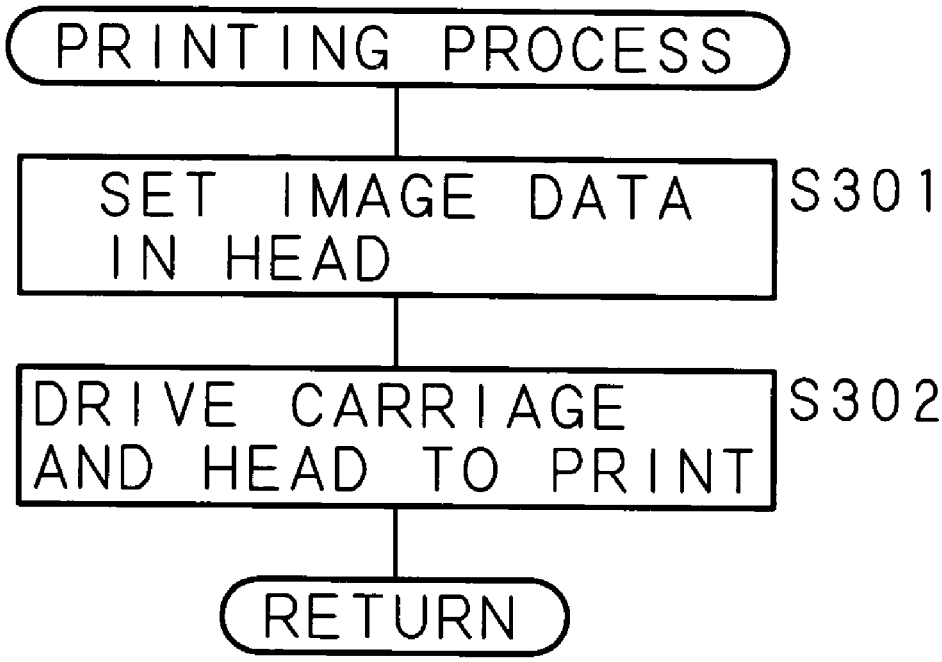
FIG. 12 is a flowchart for the printing process.

Next, a printing process executed in S102 in the print process (FIG. 9) is described using a flowchart of FIG. 12.

When the printing process is started, first in S301, image data corresponding to one band is set in the recording head 4.

Subsequently, in S302, the following process is performed. Ink is ejected from the nozzle arrays 4*k*, 4*c*, 4*y*, 4*m* of the recording head 4 based upon image data set in the recording head 4, while scanning the carriage 5 equipped with the recording head 4 in the main-scanning direction (horizontal direction). Thereafter, this printing process is completed.

In other words, in the printing process, a known process of ejecting ink based upon image data is performed. However, the image data set in the recording head 4 is data obtained by converting a color of the portion not to be recorded in the image recording region of the recording paper P into a color of which ink is not to be ejected. Thereby, the ink-ejection starting position and the ink-ejection ending position of each of the nozzles in each of the nozzle arrays 4*k*, 4*c*, 4*y*, 4*m* in the scanning direction are made different according to the angles θ1, θ2 of inclination, and ink is ejected only in the image recording region.

Figure 13:
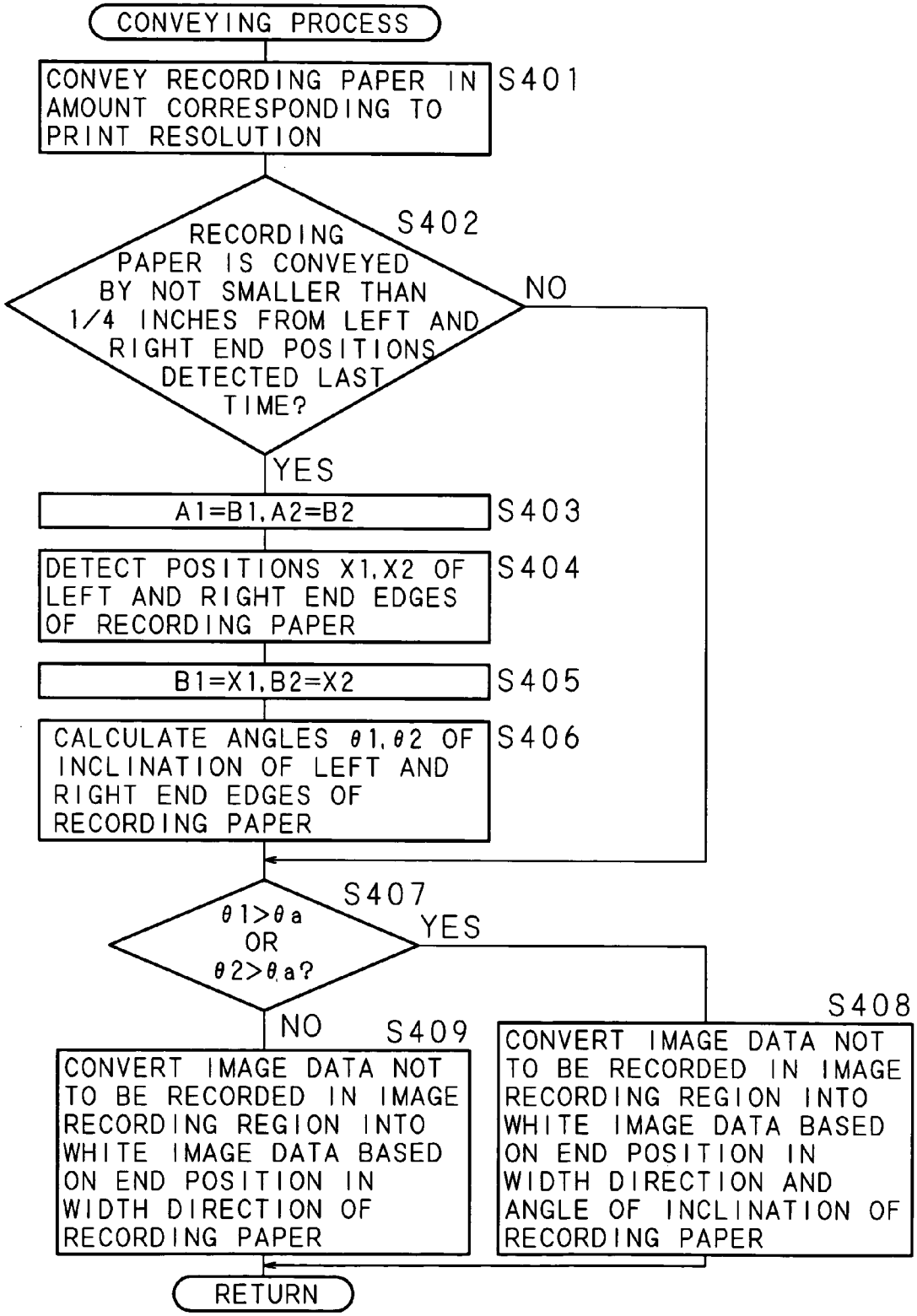
FIG. 13 is a flowchart for a conveying process.

Next, a conveying process executed in S104 in the print process (FIG. 9) is described using a flowchart of FIG. 13.

When the conveying process is started, first in S401, the recording paper P is conveyed just in amount corresponding to a print resolution of the recording paper P.

Subsequently, in S402, it is determined whether or not the recording paper P has been conveyed by not smaller than a prescribed amount (a quarter inches in this embodiment) from a position where the left and right end positions were detected last time.

When it is determined in S402 that the recording paper P has been conveyed by the prescribed amount, the process is shifted to S403, and values of the variables B1, B2 are substituted into the variables A1, A2.

Next in S404, the position X1 of the left-side end edge of the recording paper P and the position X2 of the right-side end edge of the recording paper P are detected, as in the process of S202 in the paper feed process (FIG. 10).

Next, in S405, the left-side end edge position X1 and the right-side end edge position X2, detected in S404, are respectively substituted into the variables B1, B2.

Next, in S406, a process is performed for calculating the angles θ1, θ2 of inclination of the left and right end edges of the recording paper P, as in S207 in the paper feed process (FIG. 10). Thereby, the angles θ1, θ2 of inclination calculated last time are updated to the angles θ1, θ2 of inclination calculated this time. Thereafter, the process is shifted to S407.

On the other hand, when it is determined in S402 that the recording paper P has not been conveyed by the prescribed amount, the process is shifted to S407. Namely, the angles θ1, θ2 of inclination are not updated.

In S407, as in S212 in the paper feed process (FIG. 10), it is determined whether or not at least one of the angles θ1, θ2 of inclination is larger than the standard angle θa of inclination.

When it is determined in S407 that at least one of the angles θ1, θ2 of inclination is larger than the standard angle θa of inclination, the process is shifted to S408, and the same image data conversion process as the process of S213 in the paper feed process (FIG. 10) is performed. Thereafter, this conveying process is completed.

On the other hand, when it is determined in S407 that both the angles θ1, θ2 of inclination are not larger than the standard angle θa of inclination, the process is shifted to S409, and the same image data conversion process as the process of S214 in the paper feed process (FIG. 10) is performed. Thereafter, this conveying process is completed.

As thus described, in the multi-functional device 1 of this embodiment, the angles θ1, θ2 of inclination of the left and right end edges of the recording paper P fed to the recording unit 7 are first detected (S201 to S207) prior to image recording. In the case where it is determined based upon the detected angles θ1, θ2 of inclination that the image represented by the image data is not recordable over the image recording region of the recording paper P (S208: NO), and also in the case where the input operation is performed indicating the user's intention not to continue recording (S209, S210: NO), the recording paper P is discharged and new recording paper P is fed (S211, S101). Therefore, according to the multi-functional device 1, it is possible to prevent the recording medium P and ink from being wasted due to incomplete image recording. In particular, since the user is allowed to select whether or not to continue recording, it is possible to perform a process most suitable for circumstances.

On the other hand, in the case it is determined that the image represented by the image data is recordable over the image recording region of the recording paper P (S208: YES) or even in the case where it is determined that the image represented by the image data is not recordable over the image recording region of the recording paper P (S208: NO), when the input operation is performed indicating the user's intention to continue recording (S209, S210: YES), the image data conversion process is performed for converting a color of a portion of the image represented by the image data, which is not to be recorded in the image recording region of the recording paper P, into a color of which ink is not to be ejected (S213, S214). Thereby, ink is ejected only to the image recording region of the recording paper P. Therefore, according to the multi-functional device 1, the relatively simple image data conversion process can prevent ejection of ink to the outside of the image recording region, while allowing image recording over the image recording region. Specifically, for example, when the image recording region is the whole are of the recording paper P (frameless recording), it is possible to prevent ejection of ink to a position protruding from the recording paper P, while allowing image recording on the whole area of the recording paper P. Further, also when the image recording region is a region left after formation of margins in prescribed widths on the top, bottom, left and right of the recording paper P, it is possible to obtain the effect of setting the margins to have fixed widths.

Further, according to the multi-functional device 1, also when the end edge of the recording paper P is inclined to the conveying direction due to the shape of the recording paper P itself (e.g. the shape of the recording paper P is trapezoidal), the same effect as described above can be obtained.

Furthermore, according to the multi-functional device 1, it is not required to perform the complicated process of rotationally converting image data, thereby enabling prevention of increases in cost and process time.

Meanwhile, in the multi-functional device 1, the angles θ1, θ2 of inclination are regarded as zero (S214) when the degree of inclination of the recording paper P is determined to be minute (S212: NO). It is therefore possible to prevent the recording state of the image from becoming worse rather than better caused by making the ink-ejection starting position and the ink-ejection ending position different under the influence of a detection error made by the media sensor 40, or the like.

Further, in the multi-functional device 1, when the recording paper P is conveyed by not smaller than a prescribed amount from a position where the left and right ends of the recording paper P were detected last time (S402: YES), another detection of the left and right ends of the recording paper P is made to recalculate the angles θ1, θ2 of inclination of the left and right end edges of the recording paper P (S403 to S406). It is thereby possible to accurately detect the degree of inclination even when the inclined state of the recording paper P varies according to the conveyance amount, or when the recording paper P itself has such a shape that the degree of inclination varies according to the position of the recording paper P in the conveying direction.

The following should be noted in the above-mentioned embodiments. The multi-functional device 1 corresponds to the recording apparatus. The recording head 4 corresponds to the ink ejection unit. The conveyance (resist) roller comprising the drive roller 50 and the nip roller 51 corresponds to the conveying unit. Further, the processes of S201 to S207 in the paper feed process (FIG. 10) and the processes of S403 to S406 in the conveying process (FIG. 13) correspond to the inclination detecting unit. The process of S208 corresponds to the conveying state determination unit. The liquid crystal display unit 14*b* of the operational panel unit 14 and the process of S209 correspond to the reporting unit. The operational button group 14*a* and the liquid crystal display unit 14*b* of the operational panel unit 14 and the processes of S209 and S210 correspond to the selection unit. Further, the process of S211 corresponds to the record cancellation unit. The processes of S212 and S407 correspond to the inclination determination unit. The processes of S213 and S214 and the processes of S408 and S409 correspond to the ejection position control unit. The process of S302 in the printing process (FIG. 12) corresponds to the image record unit. Further, the media censor 40 corresponds to the detecting unit.

Although one embodiment was described above, it goes without saying that a variety of embodiments can be employed.

In the multi-functional device 1 of the above embodiment, the image data conversion process is performed for converting a color of a portion of the image represented by the image data, which is not to be recorded in the image recording region of the recording paper P, into white (S213, S214, S408, S409), so that ink injection is performed only on the image recording region of the recording paper P. However, techniques other than this can also be applied.

For example, an image data conversion process may be performed for deleting image data corresponding to the portion of the image represented by the image data which is not to be recorded in the image recording region of the recording paper P. This technique also enables ejection of ink only to the image recording region of the recording paper P.

Further, in the case where the recording head 4 is configured to eject ink based upon image data and a command which are inputted, a command may be outputted to the recording head 4, the command inhibiting ejection of ink for the portion of the image represented by the image data which is not to be recorded in the image recording region of the recording paper P. This technique also enables ejection of ink only to the image recording region of the recording paper P. Furthermore, the technique can lead to realization of control of the ink-ejection position without performing an image data conversion process.

In the meantime, in the multi-functional device 1 of the above embodiment, the position of the end edge of the recording paper P in the main-scanning direction is detected using one media censor 40. However, this is not limiting on the present invention, and the position may be detected using a plurality of sensors. For example, if two sensors are provided in different positions in the sub-scanning direction, different positions at the end edge of the recording paper P in the sub-scanning direction can be detected without a change in position of the recording paper P, to calculate the angle of inclination of the end edge. Further, the use of a line sensor with a large number of sensors linearly arranged enables more accurate detection of the shape and the degree of inclination of the recording paper P.

Moreover, in the multi-functional device 1 of the above embodiment, the angles θ1, θ2 of inclination of the left and right end edges of the recording paper P are detected. However, the present invention is not limited to this, and the angle of inclination of either one of the left and right end edges may be detected. Namely, since the recording paper P is normally in rectangular shape and the angles of inclination of the left and right end edges are thus equivalent, even with a configuration where the angle of inclination of either one of the left and right end edges is detected, it is possible to obtain the same effect as obtained in the multi-functional device 1 of the above embodiment. However, as for the recording paper P having a shape not previously grasped, the degree of inclination of the other side end edge cannot be estimated from the degree of inclination of one side end edge. In order to also deal with such recording paper P, the multi-functional device 1 is preferably configured to detect the angles θ1, θ2 of inclination of the left and right end edges of the recording paper P, as the multi-functional device 1 of the above embodiment.

Further, in the multi-functional device 1 of the above embodiment, when the image represented by the image data is not recordable over the image recording region of the recording paper P for the reason that the degree of inclination of the recording paper P is large or for other reasons, a message is displayed in the liquid crystal display unit 14*b* of the operational panel unit 14 to urge an input operation for selecting whether or not to continue recording. However, the present invention is not limited to this.

For example, a message may be displayed or an input operation may be accepted on the personal computer 150. Further, an operation such as displaying an LED lamp or outputting a voice may be performed in place of or together with displaying a message.

Further, the selection by the user may be previously made. Namely, for example, with such a configuration that setting is previously made to discharge recording paper P for high quality recording while performing recording on recording paper P other than the recording paper P for high quality recording, according to the kinds of the recording paper P, it is possible to select whether or not to continue recording without stopping the image recording operation in a user's input operation standby state.

On the other hand, such a configuration is also possible that the recording paper P is discharged or recording is continued without making the selection as described above when the image represented by the image data is not recordable over the image recording region of the recording paper P.

Moreover, in the multi-functional device 1 of the above embodiment, the recording paper P is conveyed as a paper feed operation for recording the image on the recording paper P, and the left and right end positions of the recording paper P are detected in the conveyed positions. However, the present invention is not limited to this, and paper is fed more frequently than in the paper feed operation for recording the image on the recording paper P, to increase the number of detections of the left and right end positions of the recording paper P. This enables more accurate determination of the shape and the degree of inclination of the recording paper P.

As this description may be embodied in several forms without departing from the spirit of essential characteristics thereof, the present embodiment is therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

The invention claimed is:

1. A recording apparatus, comprising:

a conveying unit for conveying a recording medium;

an ink ejection unit having a plurality of nozzles; and a controller configured to:

cause the nozzles of said ink ejection unit to eject ink based upon image data representing an image, to record the image represented by the image data on the recording medium conveyed by said conveying unit, while scanning said ink ejection unit in a scanning direction orthogonal to a conveying direction of the recording medium;

calculate an angle of inclination between the conveying direction and a portion of an edge along the conveying direction of the recording medium by detecting a position of a point at each of respective ends of the portion along the conveying direction; and control an ink-ejection starting position and an ink-ejection ending position of each of the nozzles in the scanning direction at the time of image recording on the recording medium in a stripe region obtained by the controller based on said position of the point at each of respective ends of said portion of said edge and the calculated angle of inclination.

2. The recording apparatus according to claim 1, wherein said controller is further configured to determine whether or not the calculated angle of inclination is a prescribed value or higher; and to control the ink-ejection staffing position and the ink-ejection ending position of each of the nozzles in the scanning direction to be the same positions when the angle of inclination is not greater than or equal to the prescribed value.

3. The recording apparatus according to claim 1, further comprising a detecting unit for detecting a position of the edge of the recording medium, conveyed by said conveying unit, in the scanning direction in three different positions taken in the conveying direction, wherein said controller is further configured to calculate the angle of inclination based upon the detection result.

4. The recording apparatus according to claim 1, wherein said controller is further configured to control the ink-ejection staffing position and the ink-ejection ending position of each of the nozzles in the scanning direction, such that, based upon image data representing an image having a size extended from an image recording region as a region of the recording medium where an image is to be recorded, ink is ejected only for a portion of the image represented by the image data which is to be recorded in the image recording region.

5. The recording apparatus according to claim 4, wherein said controller is further configured to:

determine a portion of the image represented by the image data which is not to be recorded in the image recording region based upon the calculated angle of inclination;

perform an image data conversion process for converting the portion not to be recorded into data for which ink is not ejected; and control the ink-ejection starting position and the ink-ejection ending position of each of the nozzles in the scanning direction.

6. The recording apparatus according to claim 4, wherein said controller is further configured to:

determine a portion of the image represented by the image data which is not to be recorded in the image recording region based upon the calculated angle of inclination;

perform a process for deleting image data corresponding to the portion not to be recorded; and control the ink-ejection starting position and the ink-ejection ending position of each of the nozzles in the scanning direction.

7. The recording apparatus according to claim 4, wherein said ink ejection unit is configured so as to eject ink based upon image data and a command which are inputted, and said controller is further configured to:

determine a portion of the image represented by the image data which is not to be recorded in the image recording region based upon the calculated angle of inclination;

output to said ink ejection unit a command to inhibit ejection of ink for the portion not to be recorded; and control the ink-ejection starting position and the ink-ejection ending position of each of the nozzles in the scanning direction.

8. The recording apparatus according to claim 4, wherein said controller is further configured to:

determine whether or not the image represented by the image data is recordable over the image recording region of the recording medium conveyed by said conveying unit; and cancel image recording on the recording medium when the image data is not recordable over the image recording region of the recording medium.

9. The recording apparatus according to claim 8, further comprising a reporting unit for reporting when the image data is not recordable over the image recording region of the recording medium.

10. The recording apparatus according to claim 8, further comprising a selection unit configured to select whether or not to cancel image recording on the recording medium when the image represented by the image data is not recordable over the image recording region of the recording medium conveyed by said conveying unit, wherein said controller is further configured to cancel image recording on the recording medium when cancellation of image recording is selected by said selection unit.

11. A recording apparatus, comprising:

a conveying unit for conveying a recording medium;

an ink ejection unit having a plurality of nozzles; and an image recording unit for ejecting ink from the nozzles of said ink ejection unit based upon image data representing an image, to record the image represented by the image data on the recording medium conveyed by said conveying unit, while scanning said ink ejection unit in a scanning direction orthogonal to a conveying direction of the recording medium;

an inclination detecting unit for calculating an angle of inclination between the conveying direction and a portion of an edge along the conveying direction of the recording medium by detecting a position of a point at each of respective ends of the portion along the conveying direction; and an ejecting position control unit for controlling an ink-ejection starting position and an ink-ejection ending position of each of the nozzles in the scanning direction at the time of image recording in a stripe region obtained by the ejecting position control unit based on said position of the point at each of respective ends of said portion of said edge on the recording medium and the angle of inclination calculated by said inclination detecting unit.

12. The recording apparatus according to claim 11, further comprising inclination determination unit for determining whether or not the angle of inclination calculated by said inclination detecting unit is a prescribed value or higher; wherein said ejecting position control unit controls the ink-ejection staffing position and the ink-ejection ending position of each of the nozzles in the scanning direction to be the same positions when the angle of inclination is not greater than or equal to the prescribed value.

13. The recording apparatus according to claim 11, wherein said inclination detecting unit is configured to detect a position of the edge of the recording medium, conveyed by said conveying unit, in the scanning direction in three different positions taken in the conveying direction, and calculates, based upon the detection result, the angle of inclination.

14. The recording apparatus according to claim 11, wherein said ejecting position control unit is configured to control the ink-ejection starting position and the ink-ejection ending position of each of the nozzles in the scanning direction such that, based upon image data representing an image having a size extended from an image recording region as a region of the recording medium where an image is to be recorded, ink is ejected only for a portion of the image represented by the image data which is to be recorded in the image recording region.

15. The recording apparatus according to claim 14, wherein said ejecting position control unit is configured to determine a portion of the image represented by the image data which is not to be recorded in the image recording region based upon the angle of inclination calculated by said inclination detecting unit, and converts the portion of the image data not to be recorded into converted data for which ink is not ejected, to control the ink-ejection starting position and the ink-ejection ending position of each of the nozzles in the scanning direction.

16. The recording apparatus according to claim 14, wherein said ejecting position control unit is configured to determine a portion of the image represented by the image data which is not to be recorded in the image recording region based upon the angle of inclination calculated by said inclination detecting unit, and to delete image data corresponding to the portion not to be recorded, to control the ink-ejection starting position and the ink-ejection ending position of each of the nozzles in the scanning direction.

17. The recording apparatus according to claim 14, wherein said ink-ejection unit is configured to eject ink based upon image data and a command which are inputted, and said ejecting position control unit is configured to determine a portion of the image represented by the image data which is not to be recorded in the image recording region based upon the angle of inclination calculated by said inclination detecting unit, and to output to said ink ejection unit a command to inhibit ejection of ink for the portion not to be recorded, to control the ink-ejection starting position and the ink-ejection ending position of each of the nozzles in the scanning direction.

18. The recording apparatus according to claim 14, further comprising:

a conveying state determination unit for determining whether or not the image represented by the image data is recordable over the image recording region of the recording medium conveyed by said conveying unit; and a record cancellation unit for canceling image recording on the recording medium when the image data is not recordable over the image recording region of the recording medium.

19. The recording apparatus according to claim 18, further comprising a reporting unit for reporting when the image data is not recordable over the image recording region of the recording medium.

20. The recording apparatus according to claim 18, further comprising selection unit configured to select whether or not to cancel image recording on the recording medium when the image represented by the image data is not recordable over the image recording region of the recording medium conveyed by said conveying unit, wherein said record cancellation unit cancels image recording on the recording medium when cancellation of image recording is selected by said selection unit.

21. A recording method, comprising the steps of:

calculating an angle of inclination between a conveying direction and a portion of an edge along the conveying direction of a recording medium by detecting a position of a point at each of respective ends of the portion along the conveying direction;

controlling an ink-ejection starting position and an ink-ejection ending position of each of nozzles, arranged along the conveying direction, in a scanning direction orthogonal to the conveying direction at the time of image recording on the recording medium in a stripe region obtained based on said position of the point at each of respective ends of said portion of said edge and the calculated angle of inclination; and ejecting ink from the nozzles based upon image data representing an image, while scanning an ink ejection unit having the nozzles in the scanning direction, to record the image represented by the image data on the recording medium conveyed by said conveying unit.

22. The recording method according to claim 21, further comprising the step of determining whether or not the calculated angle of inclination is a prescribed value or higher, and controlling the ink-ejection starting position and the ink-ejection ending position of each of the nozzles in the scanning direction to be the same positions when the angle of inclination is not greater than or equal to the prescribed value.

23. The recording method according to claim 21, further comprising the step of detecting a position of the edge of the recording medium, conveyed by said conveying unit, in the scanning direction, in three different positions taken in the conveying direction, and calculating, based upon the detection result, the angle of inclination.

24. The recording method according to claim 21, further comprising the step of controlling the ink-ejection starting position and the ink-ejection ending position of each of the nozzles in the scanning direction, such that, based upon image data representing an image having a size extended from an image recording region as a region of the recording medium where an image is to be recorded, ink is ejected only for a portion of the image represented by the image data which is to be recorded in the image recording region.

25. The recording method according to claim 24, further comprising the step of determining a portion of the image represented by the image data which is not to be recorded in the image recording region based upon the calculated angle of inclination, and performing an image data conversion process for converting the portion not to be recorded into data for which ink is not ejected, to control the ink-ejection starting position and the ink-ejection ending position of each of the nozzles in the scanning direction.

26. The recording method according to claim 24, further comprising the step of determining a portion of the image represented by the image data which is not to be recorded in the image recording region based upon the calculated angle of inclination, and deleting image data corresponding to the portion not to be recorded, to control the ink-ejection starting position and the ink-ejection ending position of each of the nozzles in the scanning direction.

27. The recording method according to claim 24, further comprising the step of configuring said ink ejection unit to eject ink based upon image data and a command which are inputted, and detecting a portion of the image represented by the image data which is not to be recorded in the image recording region based upon the calculated angle of inclination, and outputting a command to inhibit ejection of ink for the portion not to be recorded to said ink ejection unit, to control the ink-ejection starting position and the ink-ejection ending position of each of the nozzles in the scanning direction.

28. The recording method according to claim 24, further comprising the step of determining whether or not the image represented by the image data is recordable over the image recording region of the recording medium conveyed by said conveying unit, and cancelling image recording on the recording medium when the image data is not recordable over the image recording region of the recording medium.

29. The recording method according to claim 28, further comprising the step of reporting when the image represented by the image data is determined not to be recordable over the image recording region of the recording medium conveyed by said conveying unit.

30. The recording method according to claim 28, further comprising the step of providing a selectable option for whether or not to cancel image recording on the recording medium when the image represented by the image data is not recordable over the image recording region of the recording medium conveyed by said conveying-unit, and cancelling image recording on the recording medium is canceled when cancellation of image recording is selected.

* * * * *